US007448181B2

(12) United States Patent
Biondi et al.

(10) Patent No.: US 7,448,181 B2
(45) Date of Patent: Nov. 11, 2008

(54) PACKING WHEEL

(75) Inventors: Andrea Biondi, Bologna (IT); Alessandro Brizzi, Crespellano (IT); Cristian Dakessian, Bologna (IT); Mirco Legnani, Bologna (IT); Antonio Vitali, Molinella (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 11/715,942

(22) Filed: Mar. 9, 2007

(65) Prior Publication Data

US 2007/0266676 A1 Nov. 22, 2007

(30) Foreign Application Priority Data

Mar. 10, 2006 (IT) ..... BO2006A0168

(51) Int. Cl.
*B65B 11/28* (2006.01)
*B65B 49/00* (2006.01)

(52) U.S. Cl. ..... 53/234; 53/206; 53/461

(58) Field of Classification Search ..... 53/206, 53/209, 233, 234, 461, 463, 228
See application file for complete search history.

(56) References Cited

U.S. PATENT DOCUMENTS 2,991,605 A 7/1961 Pollmann
3,039,606 A * 6/1962 Dearsley ..... 209/536
3,854,270 A * 12/1974 Cloud et al. ..... 53/540
3,992,855 A 11/1976 Palmieri et al.
4,648,236 A * 3/1987 Knecht ..... 53/234
4,887,408 A * 12/1989 Mattei et al. ..... 53/412
5,003,755 A * 4/1991 Draghetti ..... 53/466
5,457,932 A * 10/1995 Spada et al. ..... 53/234
5,809,747 A * 9/1998 Spatafora ..... 53/464
5,996,318 A * 12/1999 Draghetti ..... 53/466
6,047,529 A * 4/2000 Draghetti ..... 53/466
6,286,291 B1 * 9/2001 Tale' et al. ..... 53/456
6,612,094 B1 * 9/2003 Bailey et al. ..... 53/234
6,854,243 B2 * 2/2005 Sendo et al. ..... 53/234
6,968,667 B2 * 11/2005 Spatafora ..... 53/234
7,104,032 B2 * 9/2006 Spatafora et al. ..... 53/466
7,107,737 B2 * 9/2006 Spatafora ..... 53/234

FOREIGN PATENT DOCUMENTS

EP 0 553 636 A1 8/1993
EP 1 319 597 A1 6/2003
EP 1 357 037 A1 10/2003

* cited by examiner

*Primary Examiner*—Paul R Durand
(74) *Attorney, Agent, or Firm*—Harness, Dickey & Pierce P.L.C.

(57) ABSTRACT

A packing wheel for packing products in sheets of packing material, and wherein a supporting body is mounted to rotate about a central first axis of rotation, and supports a number of peripheral packing pockets, each of which receives and houses a respective product and a respective sheet of packing material, and is fitted to the supporting body in a respective peripheral position to rotate, with respect to the supporting body, about a peripheral second axis of rotation parallel to the first axis of rotation; and wherein each packing pocket is mounted to rotate about a respective third axis of rotation parallel to the relative second axis of rotation, located a given distance from the relative second axis of rotation, and rotating about the relative second axis of rotation.

16 Claims, 3 Drawing Sheets

PACKING WHEEL

PRIORITY STATEMENT

This application claims priority under 35 USC § 119 to Italian Patent Application No. BO2006A 000168, filed Mar. 10, 2006, in the Italian Intellectual Property Office, the entire contents of which are incorporated herein by reference.

The present invention relates to a packing wheel.

Though suitable for packing any product, in particular substantially parallelepiped-shaped products, the present invention may be used to advantage in the tobacco industry, for packing cigarettes, to which the following description refers purely by way of example.

BACKGROUND OF THE INVENTION

More specifically, the present invention relates to a packing wheel of the type comprising a supporting body mounted to rotate about a central first axis of rotation; and a number of peripheral packing pockets, each for receiving and housing a respective product and a respective sheet of packing material, and each fitted to the supporting body in a respective peripheral position to rotate, with respect to the supporting body, about a peripheral second axis of rotation parallel to the first axis of rotation.

SUMMARY OF THE INVENTION

It is an object of the present invention to provide a packing wheel designed to permit fast, easy, low-cost packing of said products.

According to the present invention, there is provided a packing wheel as claimed in the attached Claims.

BRIEF DESCRIPTION OF THE DRAWINGS

A non-limiting embodiment of the present invention will be described by way of example with reference to the accompanying drawings, in which.

DETAILED DESCRIPTIONS OF THE INVENTION

Figure 1:
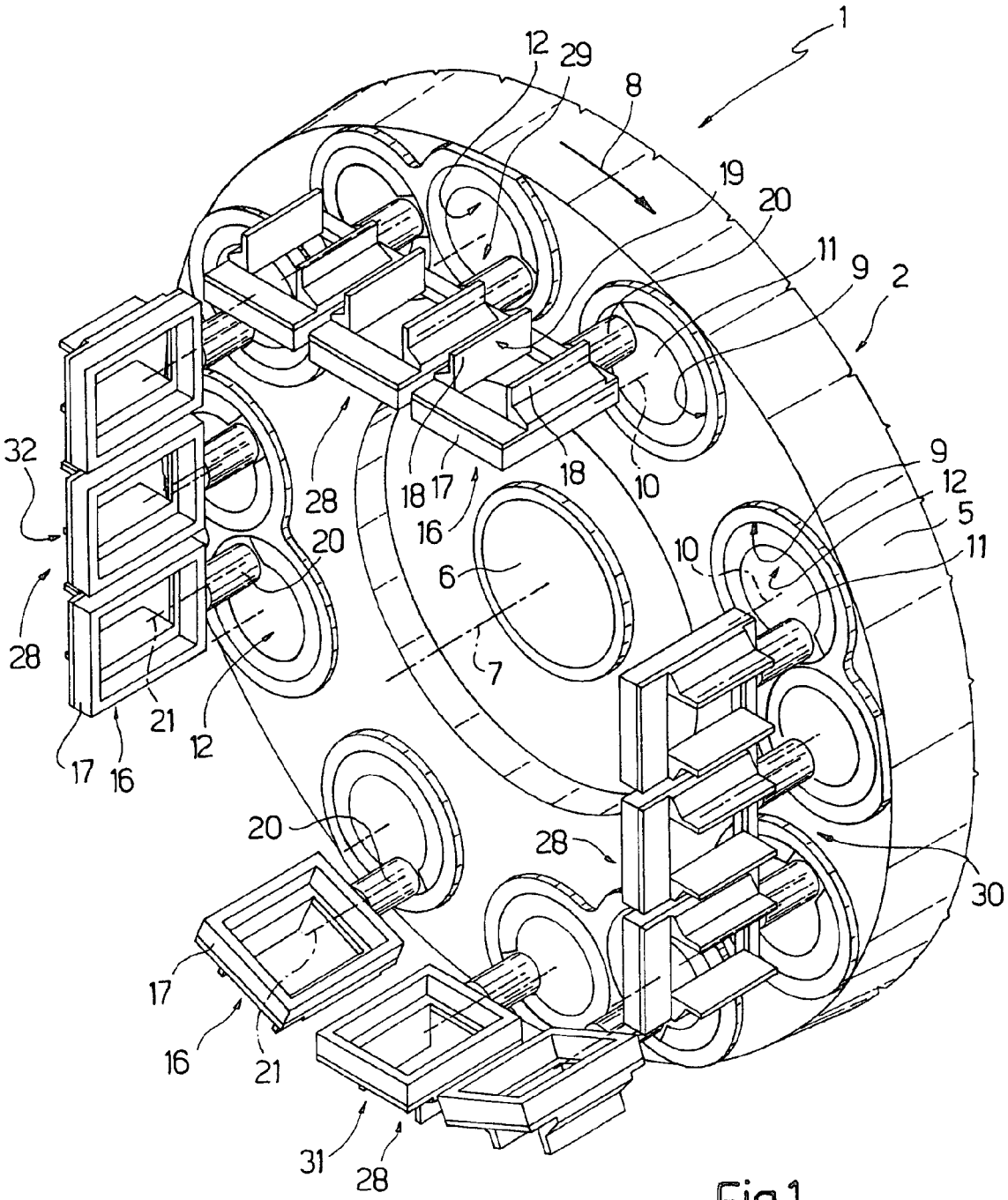
FIG. 1 shows a schematic view in perspective of a preferred embodiment of the packing wheel according to the present invention.
Figure 2:
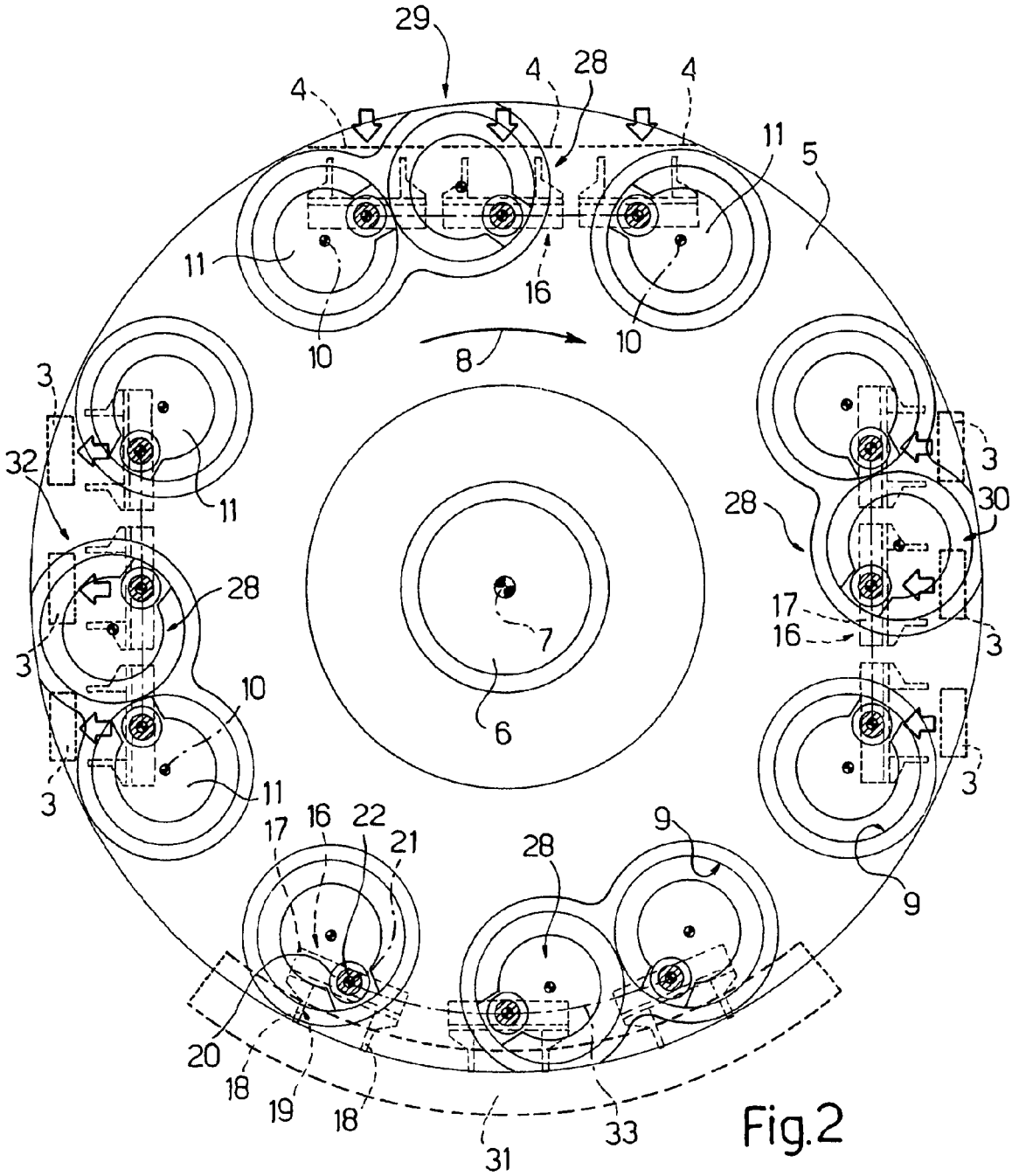
FIG. 2 shows a front view of the FIG. 1 packing wheel.

With reference to FIGS. 1 and 2, number 1 indicates as a whole a packing machine comprising a packing wheel 2, which receives a succession of products 3 (FIG. 2)—each defined, in the example shown, by a group of cigarettes wrapped in a sheet of foil—and packs each product 3 at least partly in a respective sheet of packing material 4 (FIG. 2) defined, in the example shown, by a blank.

Packing wheel 2 comprises a supporting body 5 substantially in the form of a flat disk and fitted to a drive shaft 6 rotating about a respective axis 7 in a given travelling direction 8 (clockwise in the accompanying drawings). Supporting body 5 has a number of peripheral through holes 9, each of which has a respective axis 10 parallel to axis 7, and is engaged in rotary manner by a respective shaft 11 coaxial with relative axis 10 and having a front end surface 12 coplanar with a front surface of supporting body 5.

Figure 3:
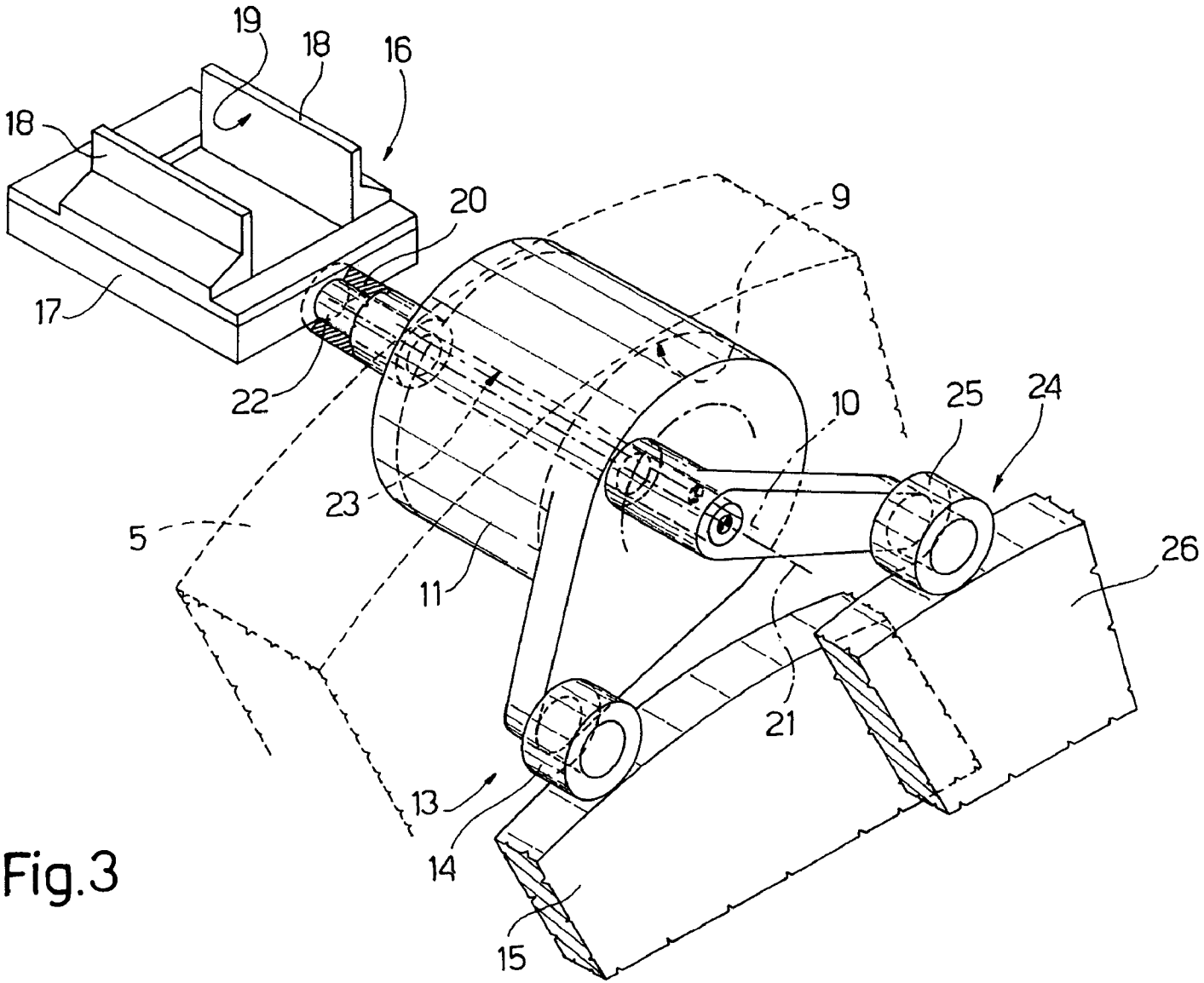
FIG. 3 shows a larger-scale, partly sectioned, schematic view in perspective of a detail in FIGS. 1 and 2.

As shown in FIG. 3, each shaft 11 is fixed axially with respect to supporting body 5, projects from the rear of supporting body 5, and is connected to an actuating device 13, which, according to a given law described below, oscillates each shaft 11 about relative axis 10 as supporting body 5 rotates about axis 7. In the example shown, actuating device 13 is a cam device comprising, for each shaft 11, a cam follower 14 connected to the rear end of relative shaft 11 and cooperating with a fixed annular cam 15 extending about axis 7.

Each shaft 11 supports a respective packing pocket 16 substantially defined by a flat rectangular frame 17 having two lateral wings 18 projecting outwards from relative frame 17 and defining the inlet of a relative seat 19, which is positioned with its concavity facing substantially radially outwards with respect to axis 7, and provides for receiving and housing a respective product 3 and a respective sheet of packing material 4.

A tubular rod 20 is connected integrally to end surface 12 of each shaft 11, and has a longitudinal axis 21 parallel to and eccentric with respect to relative axis 10, and intersecting frame 17 of relative packing pocket 16. A shaft 22 is fitted in rotary manner inside tubular rod 20, is coaxial with axis 21, has a front end connected integrally to frame 17 of relative packing pocket 16, and extends in rotary manner through a hole 23 formed along relative shaft 11 and coaxial with axis 21. Each shaft 22 has an end portion projecting from the rear of relative shaft 11 and connected to an actuating device 24, which, according to a given law described below, oscillates each shaft 22 about relative axis 21 as supporting body 5 rotates about axis 7. In the example shown, actuating device 24 is a cam device comprising, for each shaft 22, a cam follower 25 connected to the rear end of relative shaft 22 and cooperating with a fixed annular cam 26 extending about axis 7.

Consequently, rotation of each shaft 11 and relative shaft 22 about respective axes 10 and 21 corresponds to a variation in the distance of relative packing pocket 16 from axis 7, and in the position of relative packing pocket 16 with respect to supporting body 5.

As shown in FIGS. 1 and 2, shafts 11 are arranged unevenly along the periphery of supporting body 5, and respective packing pockets 16 are formed into a number of groups 28 equally spaced about axis 7 and each comprising at least two packing pockets 16. In the example shown, each group 28 comprises three packing pockets 16, the axes 10 of which are arranged unevenly along the periphery of supporting body 5. More specifically, the axes 10 of each group 28 comprise an intermediate axis 10 interposed between and at different distances from two lateral axes 10.

As shown in FIG. 2, drive shaft 6 rotates supporting body 5 in steps about axis 7 in travelling direction 8 to feed each packing pocket 16 along an annular packing path extending successively through: a transfer station 29, where each packing pocket 16 receives the respective sheet of packing material 4; a further transfer station 30, where packing pocket 16 receives respective product 3; at least one known packing station 31, where the respective sheet of packing material 4 is folded about respective product 3; and yet another transfer station 32, where packing pocket 16 releases respective product 3, together with the respective sheet of packing material 4 at least partly folded about product 3.

In a variation not shown, transfer station 29 is eliminated, and the sheets of packing material 4 are fed, together with respective products 3, directly to transfer station 30.

Actuating devices 13 and 24 selectively set packing pockets 16 in relative group 28 into a first position, in which packing pockets 16 are arranged side by side and aligned along a relative plane parallel to axis 7 and perpendicular to a relative radius of supporting body 5, and into a second position, in which packing pockets 16 are aligned with one another along a circle 33 coaxial with axis 7.

More specifically, packing pockets 16 in each group 28 are set to said first position at transfer stations 29, 30 and 32, and to said second position at packing station 31.

In both the first position and second position, packing pockets 16 in each group 28 are equally spaced along the relative plane and along circle 33 respectively.

By positioning packing pockets 16 in each group 28 in line and coplanar with one another at transfer stations 29, 30 and 32, respective sheets of packing material 4 can be fed easily, cheaply, and simultaneously to all the packing pockets 16 in group 28 at transfer station 29, respective products 3 can be fed easily, cheaply, and simultaneously to all the packing pockets 16 in group 28 at transfer station 30, and products 3 and respective sheets of packing material 4 can be unloaded easily, cheaply, and simultaneously from all the packing pockets 16 in group 28 at transfer station 32; and, by aligning packing pockets 16 in each group 28 along circle 33 at packing station 31, the sheets of packing material 4 can be folded about respective products 3 using straightforward known fixed helical folding devices (not shown) in known manner at packing station 31.

The invention claimed is:

1. A packing wheel for packing products (3) in sheets of packing material (4), comprising:

a supporting body (5) mounted to rotate about a central first axis of rotation (7);

a number of peripheral packing pockets (16) arranged, on the supporting body (5), in a number of peripheral groups (28), each having at least two packing pockets (16), each packing pocket (16) receives and houses a respective product (3) and a respective sheet of packing material (4), each packing pocket (16) being fitted to the supporting body (5) in a respective peripheral position to rotate, with respect to the supporting body (5), about a respective peripheral second axis of rotation (10) parallel to the first axis of rotation (7), and each packing pocket (16) being mounted to rotate about a respective third axis of rotation (21) parallel to the relative second axis of rotation (10), located a given distance from the relative second axis of rotation (10), and rotating about the relative second axis of rotation (10);

a first actuating device (13) for rotating the packing pockets (16) about the respective second axes of rotation (10); and a second actuating device (24) for rotating the packing pockets (16) about the respective third axes of rotation (21), so as to selectively set the packing pockets (16) in each peripheral group (28) of packing pockets (16) into a first position, in which the packing pockets (16) are arranged side by side and coplanar with one another, and into a second position, in which the packing pockets (16) are aligned with one another along a circle (33) coaxial with the first axis of rotation (7).

2. A packing wheel as claimed in claim 1, wherein each peripheral group (28) comprises three packing pockets (16), and the second axes of rotation (10) of the packing pockets (16) in each peripheral group (28) are arranged unevenly about the first axis of rotation (7).

3. A packing wheel as claimed in claim 1, wherein, in the first position, the packing pockets (16) in each peripheral group (28) of packing pockets (16) are aligned with one another and equally spaced.

4. A packing wheel as claimed in claim 1, wherein, in the second position, the packing pockets (16) in each peripheral group (28) of packing pockets (16) are equally spaced along said circle (33).

5. A packing wheel as claimed in claim 1, wherein the supporting body (5) rotates in steps about the first axis of rotation (7) in a given travelling direction (8) to feed each packing pocket (16) along an annular path and through a first transfer station (30), where the packing pocket (16) receives a respective product (3), through at least one packing station (31), where a sheet of packing material (4) is folded about the product (3), and through a second transfer station (32), where the packing pocket (16) releases the product (3) together with the respective sheet of packing material (4).

6. A packing wheel as claimed in claim 5, wherein the annular packing path extends through a further transfer station (29), where each packing pocket (16) receives a respective sheet of packing material (4); and wherein the further transfer station (29) is located upstream from the first transfer station (30) in said travelling direction (8).

7. A packing wheel as claimed in claim 5, wherein the first and second actuating devices (13, 24) set the packing pockets (16) in each peripheral group (28) of packing pockets (16) to the first position at the transfer stations (29, 30, 32), and to the second position at the packing station (31).

8. A packing wheel as claimed in claim 7, wherein the packing station (31) comprises a fixed folding device located along said circle (33) to fold each sheet of packing material (4) about the respective product (3).

9. A packing wheel as claimed in claim 1, wherein each packing pocket (16) is located a given axial distance, measured along the first axis of rotation (7), from the supporting body (5), and each packing pocket (16) is provided with a respective tubular rod (20) coaxial with the relative third axis of rotation (21) and interposed between the supporting body (5) and the relative packing pocket (16).

10. A packing wheel as claimed in claim 9, wherein each tubular rod (20) is interposed between the relative packing pocket (16) and one end of the relative first shaft (11), is integral with the relative first shaft (11), and is engaged in rotary manner by the relative second shaft (22).

11. A packing wheel as claimed in claim 1, wherein the supporting body (5) comprises, for each packing pocket (16), a first shaft (11) coaxial with the relative second axis of rotation (10) and rotating about the relative second axis of rotation (10); and a second shaft (22) supported in rotary manner by the relative first shaft (11), coaxial with the relative third axis of rotation (21), and supporting the relative packing pocket (16) eccentrically with respect to the relative second axis of rotation (10).

12. A packing wheel as claimed in claim 1, wherein each first shaft (11) is connected to the relative first actuating device (13), and each second shaft is connected to the relative second actuating device (24).

13. A packing wheel as claimed in claim 1, wherein the first and second actuating devices (13, 24) are cam actuating device.

14. A packing wheel for packing products (3) in sheets of packing material (4), comprising a supporting body (5) mounted to rotate about a central first axis of rotation (7); and a number of peripheral packing pockets (16) arranged, on the supporting body (5), in a number of peripheral groups (28), each having three packing pockets (16), each packing pocket (16) receives and houses a respective product (3) and a respective sheet of packing material (4), each packing pocket (16) being fitted to the supporting body (5) in a respective peripheral position to rotate, with respect to the supporting body (5), about a respective peripheral second axis of rotation (10) parallel to the first axis of rotation (7), and each packing pocket (16) being mounted to rotate about a respective third axis of rotation (21) parallel to the relative second axis of rotation (10), located a given distance from the relative second axis of rotation (10), and rotating about the relative second axis of rotation (10), wherein the second axes of rotation (10) of the packing pockets (16) in each peripheral group (28) are arranged unevenly about the first axis of rotation (7).

15. A packing wheel for packing products (3) in sheets of packing material (4), comprising:

a supporting body (5) mounted to rotate about a central first axis of rotation (7); and a number of peripheral packing pockets (16), each for receiving and housing a respective product (3) and a respective sheet of packing material (4), and each fitted to the supporting body (5) in a respective peripheral position to rotate, with respect to the supporting body (5), about a respective peripheral second axis of rotation (10) parallel to the first axis of rotation (7), wherein:

each packing pocket (16) is mounted to rotate about a respective third axis of rotation (21) parallel to the relative second axis of rotation (10), located a given distance from the relative second axis of rotation (10), and rotating about the relative second axis of rotation (10);

each packing pocket (16) is located a given axial distance, measured along the first axis of rotation (7), from the supporting body (5);

each packing pocket (16) is provided with a respective tubular rod (20) coaxial with the relative third axis of rotation (21) and interposed between the supporting body (5) and the relative packing pocket (16); and each tubular rod (20) is interposed between the relative packing pocket (16) and one end of a relative first shaft (11), is integral with the relative first shaft (11), and is engaged in rotary manner by a relative second shaft (22).

16. A cigarette packing machine comprising a packing wheel (2) as claimed in claim 1.

* * * * *